US005114337A

United States Patent [19]

Yamazaki

[11] Patent Number: 5,114,337

[45] Date of Patent: May 19, 1992

[54] HEAT FIXING METHOD

[75] Inventor: Masuo Yamazaki, Kawasaki, Japan

[73] Assignee: Canon Kabushiki Kaisha, Tokyo, Japan

[21] Appl. No.: 522,047

[22] Filed: May 11, 1990

[30] Foreign Application Priority Data

May 11, 1989 [JP] Japan ..... 1-116052

[51] Int. Cl.[5] ..... F27B 9/28; G03G 15/20

[52] U.S. Cl. ..... 432/8; 432/60; 432/59; 219/216; 219/469

[58] Field of Search ..... 432/60, 59, 75, 228

[56] References Cited

U.S. PATENT DOCUMENTS

| | | | |
|---|---|---|---|
| 3,578,797 | 5/1971 | Hughes et al. . | |
| 4,393,804 | 7/1983 | Nygand et al. | 432/75 |
| 4,711,549 | 12/1987 | Roodbeen | 432/60 |
| 4,780,742 | 10/1988 | Takahashi et al. | 432/60 |
| 4,829,931 | 5/1989 | Mogi | 432/60 |
| 4,888,264 | 12/1989 | Matsumoto et al. . | |
| 4,957,774 | 9/1990 | Doi et al. . | |

FOREIGN PATENT DOCUMENTS 51-29825 8/1976 Japan .

*Primary Examiner*—Henry C. Yuen

*Attorney, Agent, or Firm*—Fitzpatrick, Cella, Harper & Scinto

[57] ABSTRACT

A method of heat fixing a toner image comprises heat fixing a toner image on a recording material with a heating member fixed and supported and a pressurizing member which is opposed to, in pressure contact with said heating member and adapted to bring said recording material into pressure contact with said heat member through a film, wherein said toner image is formed of a toner, said toner comprises a binder resin and a colorant, said binder resin has a melt viscosity of 0.1 to $10^7$ centipoise at 140° C. and the gradient ($\theta$) of the straight line represented by the following formula comprising the reciprocal number (1/T) of the absolute temperature when the toner is melted by heating with the heating member and the logarithm (log $\eta$) of the melt viscosity of the binder resin at this time is $10^2$ to $3\times10^3$:

$$\log \eta = \theta\cdot(1/T) + B'$$

(where B' represents a constant); and peeling off said film from the surface of the recording material having the fixed toner image under the temperature condition which is higher than the temperature $T_4$ of the maximum value of the heat absorption peak of said toner, wherein the temperature $T_4$ of the maximum value of the heat absorption peak of the toner is 40 to 120 C., and the temperature $T_3$ when the film is pelled off from the fixed toner image surface is higher by 30° C. or more than the temperature $T_4$.

12 Claims, 3 Drawing Sheets

MAXIMUM VALUE ($T_4$) OF HEAT ABSORPTION PEAK OF TONER BY DSC

HEAT FIXING METHOD

BACKGROUND OF THE INVENTION

1. Field of the Invention

This invention relates to a heat fixing method in which a toner image on a transfer material formed by a heat meltable toner is heat fixed.

2. Related Background Art

In the prior art, for the fixing device to be used in the heat fixing method, there have been frequently used the roller fixing systems which perform heating and pressurization of, while conveying, a transfer material having an unfixed toner image sandwiched between the heating roller maintained at a predetermined temperature and a pressurizing roller pressure contacted with the heating roller. However, in the device of this kind, for prevention of the phenomenon of transfer of toner to the heating roller (so called off-set phenomenon), the heating roller is required to be maintained at an optimum temperature, and further the heat capacity of the heating member for heating the heating roller must be made large. If the heat capacity of the heating member is small, the heat capacity of the heating roller becomes small, and in that case, from the relationship with the heat content supplied by the heating member, the temperature of heating roller is susceptible to great changes by paper passage or other external factors. When that temperature is changed toward the lower temperature side, fixing failure or low temperature off-set occurs due to shortage of softening melting of the toner, while when changed toward the higher temperature side, the toner will be completely melted, whereby high temperature off-set occurs due to lowering in agglomeration force of the toner. If the heat capacity of the heating member is made larger for avoiding such problems, the time for elevating the temperature of the heating roll to a predetermined temperature becomes longer, whereby there ensues the problem that the waiting time becomes longer in using the fixing device. U.S. Pat. No. 3,578,797 proposes a method of fixing without occurrence of off-set by use of a heating member, by heat melting a toner image, then cooling the toner image to make it under a relatively higher viscosity state, followed by peel-off of the transfer material having the toner image from the heating member web under the state where the tendency of attachment of toner is weakened. However, since this method employs the method of heating without pressure contacting the toner image and the transfer material against the heating member, the heat transmission efficiency between the heating member and the toner image becomes poorer, whereby enormous energy is required for fixing.

Japanese Patent Publication No. 51-29825 proposes a method of heat melting a toner image within a short time by effecting improvement of heat transmission efficiency by pressure contacting the heating member with the toner image. However, this method employs a system in which heating is effected under the state where the toner image and the transfer material are previously sandwiched under pressure between a pair of heating members, and thereafter cooling is effected compulsorily. Specifically, the toner image is heated with a pair of heating members from both front and back surfaces, and therefore it appears that such method is efficient in aspect of energy. Practically, however, energy efficiency is consequently poor, for such reasons that the toner image is required to be sufficiently heated from the transfer material side, and further that a compulsory cooling means is required because the toner image cannot be peeled off unless the transfer material once heated is abruptly cooled in the subsequent cooling step. Further, since a heating member with relatively larger heat capacity is used, heat dissipation into the machine is increased, whereby there was also the problem that unnecessary temperature elevation within the machine was brought about.

SUMMARY OF THE INVENTION

An object of the present invention is to provide a heat fixing method which has solved the above problems.

Another object of the present invention is to provide a heat fixing method excellent in off-set resistance characteristic.

According to the present invention, there is provided a method of heat fixing a toner image, comprising heat fixing a toner image on a recording material with a heating member fixed and supported and a pressurizing member which is in pressure contact with said heating member as opposed thereto and adapted to bring said recording material into pressure contact with said heating member through a film, wherein said toner image is formed of a toner, said toner comprises a binder resin and a colorant, said binder resin has a melt viscosity of 0.1 to $10^7$ centipoise at 140° C. and the gradient ($\theta$) of the straight line represented by the following formula comprising the reciprocal number (1/T) of the absolute temperature when the toner is melted by heating with the heating member and the logarithm (log $\eta$) of the melt viscosity of the binder resin at this time is $10^2$ to $3\times10^3$:

$$\log \eta = \theta\cdot(1/T) + B'$$

(where B' represents a constant); and peeling off said film from the surface of the recording material having the fixed toner image under the temperature condition which is higher than the temperature $T_4$ of the maximum value of the heat absorption peak of said toner.

BRIEF DESCRIPTION OF THE DRAWINGS

In the accompanying drawings.

DETAILED DESCRIPTION OF THE INVENTION

Figure 1:
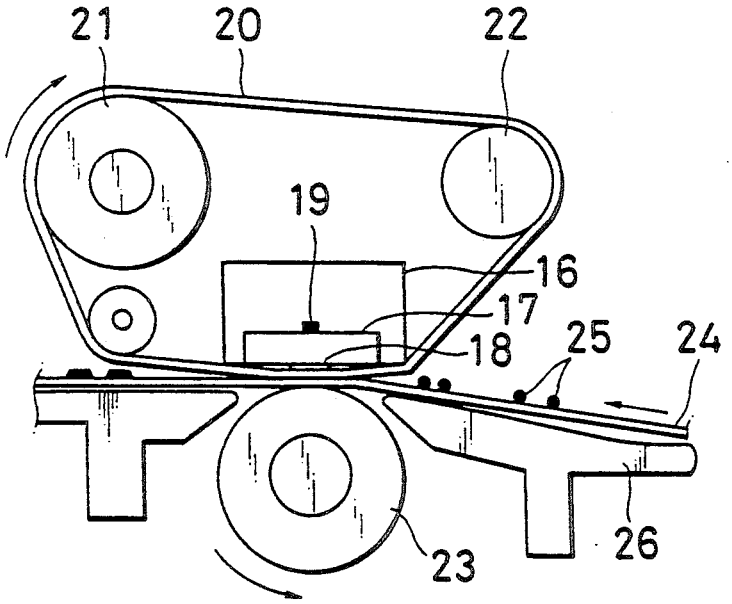
FIG. 1 and FIG. 2 show heat fixing devices for practicing the heat fixing method of the present invention.

Referring now to the drawings, the present invention is described in detail. FIG. 1 is an example of schematic illustration of a fixing device according to the present invention.

The heat fixing device in FIG. 1 has a constitution for peeling off positively the fixed toner image from the surface of the film 20 under the heat molten state of the toner 25 as such with a low heat capacity linear heating member 16.

The heat fixing device has a low heat capacity linear heating member 16, and as an example of the low heat capacity linear heating member 16, one having a resistance material 18 coated to a width of 1.0 mm on an alumina substrate 17 having a thickness of 1.0 mm, a width of 10 mm and a longer length of 240 mm may be employed. As the current passed from the both ends in the longer direction of the heating member 16, for example, a pulse waveform with a frequency of 20 msec of DC 100 V may be used, and the pulse width of the current is varied corresponding to the desired temperature controlled by the temperature detecting device 19 and the amount of the energy discharged. Approximately, the pulse width becomes 0.5 msec to 5 msec. Thus, the fixing film 20 having heat resistance moves in the arrowhead direction in the drawing in contact with the heating member 16 controlled in energy and temperature. As an example of such film, an endless film 20 which is prepared by coating a release layer having an electroconductive material dispersed therein to 10 μm on at least the toner image contacting side of a heat-resistant film with a thickness of 20 μm may be exemplified.

Generally speaking, the total thickness of the heat-resistant film may be 100 μm or less, preferably less than 40 μm, more preferably 5 to 35 μm. The film is driven by driving with the driving roller 21 and the sub-roller 22 and tension to be moved in the arrowhead direction.

Numeral 23 is a pressure roller having a rubber elastic layer with good releasability such as of silicone rubber, which pressurizes the heating member 16 through a film 20 under a total pressure of 4 to 20 Kg. The pressurizing roller 23 rotates while pressurizing the passing recording member. The unfixed toner 25 on the recording material (e.g. transfer material such as plain paper) 24 is led by the inlet guide 26 to the fixing section, and a fixed toner image is obtained by heating and pressurization as described above.

Figure 2:
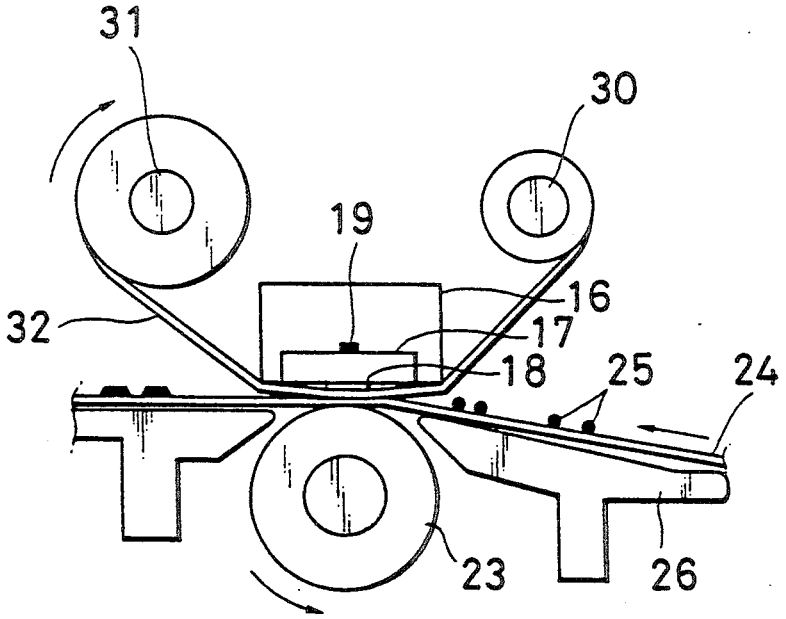

Having described above with reference to an endless belt, a sheet delivery shaft 30 and a wind-up shaft 31 may be employed, and the fixing film may be also a film 32 having ends as shown in FIG. 2.

The fixing film 20 or 32 to be used in the heat fixing method of the present invention is not limited to a single layer constitution, but may be of a plural layer constitution having a layer formed of a polymeric material such as fluorine type resin with good peelability on a fixing film. When the surface of the fixing film is coated with an insulatng copolymer of tetrafluoroethylene-perfluoroalkyl vinyl ether (PFA resin), electrostatic charges which disturb the toner image are liable to be generated on the fixing film, and therefore it is preferable to effect deelectrification with a deelectrifying brush, etc. provided to cope with such problem.

Further, it is also preferable to prevent image disturbance with electrostatic charges by addition of an electroconductive material such as electroconductive fiber or carbon black in the coating resin.

The thickness of the fixing film to be used in the present invention may be 100 μm or less, preferably less than 40 μm, more preferably 5–35 μm.

As the fixing film, there may be included sheets of polyester, polyethylene terephthalate (PET), tetrafluoroethylene-perfluoroalkyl vinyl ether copolymer (PFA), polytetrafluoroethylene (PTFE), polyimide, polyamide, and aluminum metal sheet, further coated sheets having a metal laminated or vapor deposited on polymer sheets.

Among them, polyimide film is preferable with respect to heat resistance and strength.

As the binder resin of the toner to be used in the present invention, there may be preferably used one having a melt viscosity of 0.1 to $10^7$ (preferably 1 to $9\times10^4$, more preferably $10^2$ to $2\times10^4$) centipoise at 140° C. and a gradient ($\theta$) of the straight line represented by the following formula comprising the reciprocal nubmer (1/T) of the absolute temperature when the toner is melted by heating with the heating member and the logarithm (log $\eta$) of the melt viscosity of the binder resin at this time, which gradient is $10^2$ to $3\times10^3$:

$$\log \eta = \theta\cdot(1/T) + B'$$

(where B' represents a constant).

Here, the viscosity is measured by use of a rotor type viscometer (e.g. Viscometer B type, manufactured by Tokyo Keiki K.K.). The melt viscosity ($\eta$) of the binder resin to be used in the present invention satisfies the following formula:

$$\eta = \tau/D$$

($\tau$: shear stress, D: speed gradient), and exhibits Newtonean viscosity in which $\tau$ increases linearly with increase of D. In the examples described below, when the logarithm of the viscosity measured here (log $\eta$) and the reciprocal of the temperature at that time were plotted, the results were well coincident with the following Andrade equation:

$$\text{Andrade equation} \quad \log \eta = \log A + U/RT$$

where U represents an apparent activation energy, R a gas constant, T an absolute temperature and A a constant, thus exhibiting good linearity.

Since the measured viscosity is the shearing speed to the shearing stress, the apparent activation energy is said to correspond to a measure showing the flow characteristics of a substance. The gradient of the melt viscosity and the reciprocal of the temperature used in the present invention indicates the physical amount corresponding to the apparent activation energy, indicating the flowability of the toner melted on the recording material in the heating step, which is an effective physical amount for preventing blurring of image, penetration of the molten toner into the recording material.

In the heat fixing device shown in FIG. 1, when the temperature detected by the temperature detecting device 19 provided on the back surface of the low heat capacity linear heating member 16 is made $T_1$, the surface temperature $T_2$ of film 20 opposed to the resistance material 18 is generally lower by about 10° to 30° C. than $T_1$. Further, the surface temperature $T_3$ of the film 20 at the site where the film 20 is peeled off from the toner fixing surface generally exhibits a temperature substantially equal to $T_2$. The temperature during fixing in the fixing device in FIG. 1 and FIG. 2 means generally the temperature of $T_3$.

In the present invention, if the melt viscosity of the binder resin of the toner is less than 0.1 centipoise at a temperture of 140° C., the toner is excessively melted in the heat fixing step to be penetrated into the recording material, whereby worsening of the toner fixed image is brought about.

On the other hand, if the melt viscosity of the binder resin exceeds $10^7$ centipoise at a temperature of 140° C., deformation of the toner occurs with difficulty, consequently causing poor fixing to occur. Further, these ensues the problem that excessive energy is required for heat fixing to take a long fixing time. The gradient of the straight line comprising the logarithm of melt viscosity and the reciprocal of temperature is a measure indicating flowability of the binder resin of the toner accompanied with heating energy change, and greatness of this value also means sharp meltability exhibiting abrupt viscosity change to the applied heat content.

Figure 3:
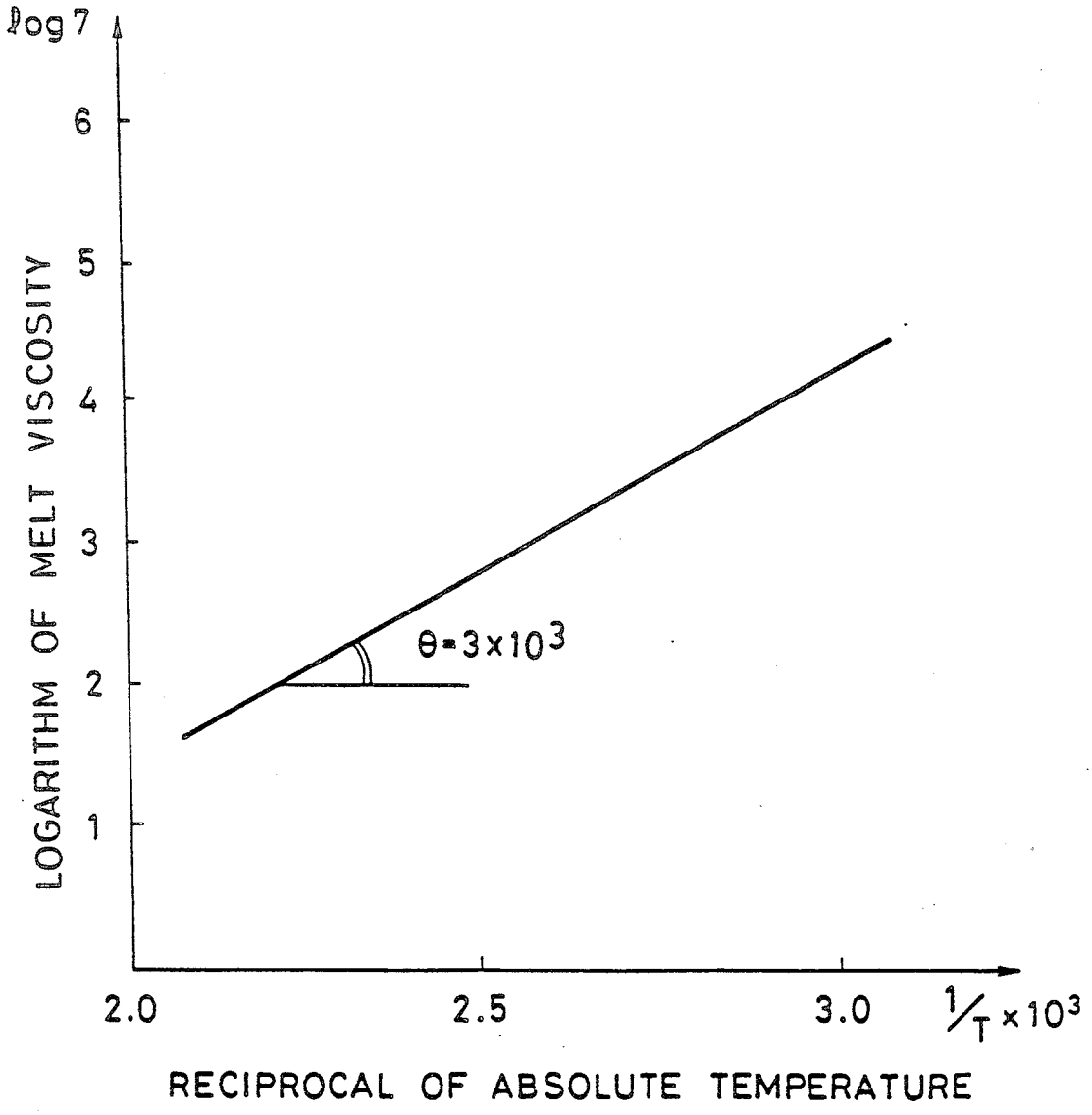
FIG. 3 shows the temperature-viscosity characteristics of the binder resins used in the present invention.

A measurement example of the gradient ($\theta$) of the binder resin to be used in the present invention is shown in FIG. 3. The axis of ordinate shows the logarithm of the viscosity, and the axis of abscissa be reciprocal of the absolute temperature during measurement.

The toner to be used in the present invention is preferably a toner which exhibits 40° C. to 120° C. of the maximum value $T_4$ of the heat absorption peak appearing at first as measured by the differential scanning calorimetry (DSC) in the measurement temperature range of from 10° C. to 200° C., particularly preferably a toner exhibiting 55° C. to 100° C. of the maximum value of $T_4$.

Further, it is particularly effective for prevention of off-set onto the film surface to effect peeling of the film from the fixed toner image surface at a temperature $T_3$ which is higher by 30° C. or more, more preferably by 40° C. to 150° C., than the above-mentioned temperature $T_4$.

As the method for measuring the maximum value of the heat absorption peak to be used in the present invention, ASTM S3418-82 can be utilized.

Figure 4:
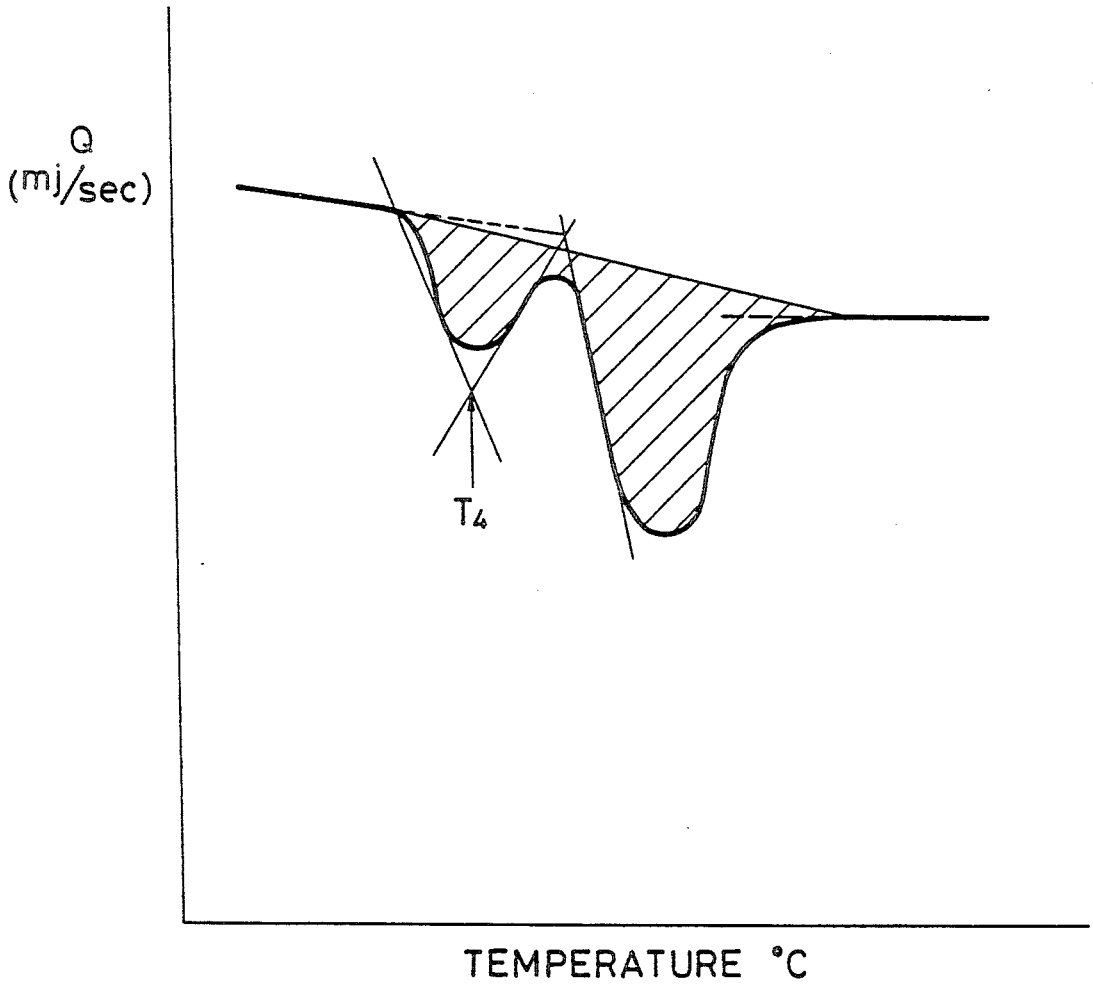
FIG. 4 shows the chart of DSC of the toner used in the present invention.

Specifically, after 10 to 15 mg of a toner is sampled and heated under nitrogen atmosphere from room temperature to 200° C. at a temperature elevation speed of 10° C./min, it is maintained at 200° C. for 10 minutes and then quenched to effect previously pretreatment of the toner, followed again by maintenance at 10° C. for 10 minutes, and measurement is performed by heating to 200° C. at a temperature elevation speed of 10° C./min. A specific measurement example is shown in FIG. 4.

In the present invention, the relative relationships between the temperatures of the respective sites of the heat fixer and the temperature characteristic of the toner may preferably be set as shown below:

$$T_1<T_2<T_3<T_4$$

As the binder resin of the toner to be used in the present invention, there are various resins and waxes which satisfy the viscosity characteristics as defined in the present invention. For example, there may be exemplified petroleum waxes such as microcrystalline wax, paraffin wax, polyethylene wax (low density, high density; oxidized type, non-oxidized type), ethylene-vinyl acetate copolymer; vegetable waxes such as carunauba wax, canderilla wax, wood wax, rice wax; animal waxes such as beeswax, lanolin; mineral waxes such as montan wax, ceresin; non-crosslinked styrene copolymers with relatively lower molecular weights and sharp molecular weight distributions; polyesters. These binder resins can be used alone or in mixtures.

Resins of high molecular weights crosslinked to high degree do not exhibit the viscosity characteristics of the present invention, and cannot be used alone.

In the heat fixing method of the present invention, a toner having a volume average particle size of 4 to 13 μm may be generally used.

The toner contains a dye, pigment or magnetic material as the colorant.

Examples of the dye or pigment may include carbon black, graphite, nigrosin, metal complexes of monoazo dyes, ultramarine, phthalocyanine blue, Hanza yellow, benzine yellow, various lake pigments such as quinacridone. Non-magnetic dye or pigment may be used generally in an amount of 0.1 to 30 parts by weight (preferably 0.5 to 20 parts by weight) per 100 parts be weight of the binder resin.

As the magnetic material, materials exhibiting magneticity or magnetizable materials may be employed. For example, there are metals such as iron, manganese, nickel, cobalt, chromium; magnetite, hematite, various ferrites, manganese alloys and other ferromagnetic alloys. These can be used in the form of fine powder with an average particle size of about 0.05 to 1μ (preferably 0.05 to 0.5μ). The amount of the magnetic material contained in the toner may be preferably 15 to 70% by weight (more preferably 25 to 45% by weight) of the total weight of the toner.

Further, a charge controller may be also added in the toner for charge control.

As the charge controller for controlling the toner to negatively chargeable, there are the following substances.

For example, there are monoazo metal complexes, acetylacetone metal complexes, aromatic hydroxycarboxylic acids, aromatic dicarboxylic type metal complexes. Otherwise, there may be included aromatic hydroxycarboxylic acids, aromatic mono- and polycarboxylic acids and metal salts thereof, anhydrides, esters, phenol derivatives such as bisphenol, etc.

As the charge controller which controls the toner positively chargeable, there are the following substances.

For example, there may be included nigrosine, nigrosine modified products with fatty acid metal salts, tributylbenzyl-ammonium-1-hydroxy-4-naphthosulfonic acid salt, quaternary ammonium salts such as tetrabutylammonium tetrafluoroborate, triphenylmethane dyes and lake pigments of these (as the lake formation agent, phosphotungstic, phosphomolybdic acid, phosphotungstromolybdic acid, tannic acid, lauric acid, gallic acid, ferricyanide, ferrocyanide), metal salts of higher fatty acids. Among them, charge controllers such as nigrosine type, quaternally ammonium salt may be particularly preferably employed.

In the toner of the present invention, for improvement of charging stability, developability, flowability and durability, silica fine powder may be preferably added.

The silica fine powder to be used in the present invention may have a specific surface area within the range of 30 $m^2/g$ or more (particularly 50 to 400 $m^2/g$) by nitrogen adsorption measured by the BET method to give good results. Silica fine powder may be used in an amount of 0.01 to 8 parts by weight, preferably 0.1 to 5 parts by weight, based on 100 parts by weight of the toner.

The silica fine powder to be used in the present invention, if necessary, may be also preferably treated with a treating agent silicone varnish, various modified silicone varnishes, silicone oil, various modified silicone oils, silane coupling agents, silane coupling agents having functional groups, and other organic silicon compounds for the purpose of controlling hydrophobicity and chargeability.

Particularly, it is preferable for improving off-set resistance characteristic of the toner onto the fixing film and prevention of damage of the fixing film surface to impart a treated colloidal silica treated with 1 to 50 parts by weight of a silicone oil such as dimethylsilicone oil per 100 parts by weight of the dry process colloidal silica fine powder produced by the dry process having a BET specific surface area of 100 to 400 $m^2/g$. The treated colloidal silica may be preferably used in an amount of 0.1 to 5 parts by weight per 100 parts be weight of the toner.

The present invention is described in detail below by referring to Examples.

EXAMPLE 1

As the binder resin, a mixture of a low density polyethylene and a paraffin wax from which low molecular weight components were removed formulated at a weight ration of 4:1 was used. The viscosity characteristics of the binder resin are shown below.

Melt viscosity (140° C.)=1800 centipoise (namely 18 poise).

$\theta=2\times10^2$.

100 Parts by weight of the above binder resin were mixed with 60 parts by weight of a magnetic material and 2 parts by weight of a charge controller, sufficiently kneaded, then cooled, crushed and classified to obtain a toner of a volume average particle size of 12 μm with $T_4$ of 62° C. By use of the magnetic toner and a plain paper as the recording material, fixing test was conducted by use of a heat fixing device shown in FIG. 1.

As the fixing film 20, a polyimide film with a thickness of 20 μm having a release layer with low resistance having an electroconductive substance (carbon black) dispersed in polytetrafluoroethylene (PTFE) at the contact surface with the recording material (plain paper) was used. The fixing test was conducted by setting the respective sites of the fixer to $T_1$ 170° C., $T_2$ 140° C. and $T_3$ 145° C., under the conditions of a total pressure between the linear heating member 16 and the pressure roller 23 of 8 Kg, a nip of 3 mm between the pressure roller 23 and the fixing film 20, and a rotation speed of the fixing film 20 of 100 mm/sec.

The fixing characteristics of the fixed toner image obtained were judged by placing the test strip on a glass flat plate, superposing 5 sheets of lens cleaning paper "dusper" (manufactured by OZU paper Co., Ltd.) thereon, performing sliding friction along the watermark of the plain paper under an application pressure of 40 $g/cm^2$ for 5 reciprocations and calculating the ration of lowering the image density before and after the sliding for judgement of goodness or badness of fixing characteristics. The density lowering ratio was found to be low as 10%, and neither blurring nor print-through of the toner image was seen.

Further, no off-set phenomenon of the toner to the fixing film 22 was recognized. The plain paper having unfixed toner image was passed continuously for 1000 sheets to effect heat fixing, whereby no off-set phenomenon to the fixing film 22 was observed.

EXAMPLE 2

A toner was prepared in the same manner as in Example 1 except for using a mixture of a low molecular weight polypropylene and a polyester formulated at a weight ratio of 1:5 as the binder resin of the toner.

The viscosity characteristics of the binder resin at this time were as follows:

Melt viscosity (140° C.)=$2\times10^4$ centipoise (namely $2\times10^2$ poise).

$\theta=10^3$.

By use of this toner, fixing was performed by use of the fixing device shown in Example 1 except for changing the setting temperature as shown below:

$T_1$: 200° C.
$T_2$: 190° C.
$T_3$: 190° C.
$T_4$: 65° C.

The density lowering ratio was found to be as low as 12.5%, the fixing property was good, and no blurring, print-through, etc. of image was observed.

EXAMPLE 3

By utilizing the toner used in Example 1 and using the fixing device shown in FIG. 2, heat fixing was performed and the fixed toner image was evaluated.

The density lowering ratio before and after sliding friction was as low as 13%, thus exhibiting good fixability.

COMPARATIVE EXAMPLE

A toner was prepared in the same manner as in Example 1 except for using a crosslinked styrene-butyl acrylate-divinyl benzene copolymer as the binder resin of the toner, and fixing was evaluated. The viscosity of the binder resin could not be measured under 140° C. due to the gel component (high molecular component insoluble in tetrahydrofuran) existing in the resin, and is outside of the range of the present invention. As the result of the fixing test, the density lowering ratio before and after sliding friction was as poor as 30%, and further peeling between the plain paper and the toner image was also extremely bad.

EXAMPLE 4

100 Parts by weight of the dry process colloidal silica fine powder with a BET specific surface area of 200 $m^2/g$ were subjected to the surface treatment with 10 parts by weight of dimethyl-silicone oil to prepare treated colloidal silica fine powder having dimethylsilicone oil carried thereon.

0.8 Part by weight of said treated colloidal silica fine powder and 100 parts by weight of the toner prepared in Example 1 were mixed to have said treated colloidal silica fine powder electrostatically attached onto the toner particle surfaces.

The unfixed toner image formed with the toner having said treated colloidal silica fine powder was heat fixed similarly as in Example 1. Fixing test was performed continuously for 3000 sheets, but no off-set phenomenon appeared and there was also no damage of the fixed film surface.

EXAMPLE 5

100 Parts by weight of the dry process colloidal silica fine powder with a BET specific surface area of 200 $m^2/g$ were subjected to the surface treatment with 15 parts by weight of dimethyl silicone oil to prepare treated colloidal silica fine powder having dimethylsilicone oil carried thereon.

0.8 Part by weight of said treated colloidal silica fine powder and 100 parts by weight of the toner prepared in Example 2 were mixed to have said treated colloidal silica fine powder electrostatically attached onto the toner particle surfaces.

The unfixed toner image formed with the toner having said treated colloidal silica fine powder was heat fixed similarly as in Example 2. Fixing test was performed continuously for 3000 sheets, but no off-set phenomenon appeared and there was also no damage of the fixed film surface.

What is claimed is:

1. A method of heat fixing a toner image, comprising heat fixing a toner image on a recording material with a heating member fixed and supported and a pressurizing member which is opposed to, in pressure contact with said heating member and adapted to bring said recording material into pressure contact with said heating member through a film, wherein said toner image is formed of a toner, said toner comprises a binder resin and a colorant, said binder resin has a melt viscosity of 0.1 to $10^7$ centipoise at 140° C. and the gradient ($\theta$) of the straight line represented by the following formula comprising the reciprocal number (1/T) of the absolute temperature when the toner is melted by heating with the heating member and the logarithm (log $\eta$) of the melt viscosity of the binder resin at this time is $10^2$ to $3\times10^3$:

$$\log \eta = \theta.(1/T) + B'$$

(where B' represents a constant); and peeling off said film from the surface of the recording material having the fixed toner image under the temperature condition which is higher than the temperature $T_4$ of the maximum value of the heat absorption peak of said toner, wherein the temperature $T_4$ of the maximum value of the heat absorption peak of the toner is 40° to 120° C., and the temperature $T_3$ when the film is peeled off from the fixed toner image surface is higher by 30° C. or more than the temperature $T_4$.

2. The method according to claim 1, wherein the toner contains colloidal silica treated with a silicone oil, the binder resin of the toner has a melt viscosity at 140° C. of 1 to $9\times10^4$ centipoise, and the toner image is heat fixed with a fixing film having a layer formed of a polyimide resin and a layer formed of a fluorine type resin.

3. The method according to claim 1, wherein the temperature $T_4$ is 55° C. to 100° C., and the temperature $T_3$ is higher by 40° to 150° C. than the temperature $T_4$.

4. The method according to claim 1, wherein the binder resin has a melt viscosity at 140° C. of 1 to $9\times10^4$ centipoise.

5. The method according to claim 1, wherein the binder resin has a melt viscosity at 140° C. of $10^2$ to $2\times10^4$.

6. The method according to claim 1, wherein the fixing film is formed of a polyimide resin.

7. The method according to claim 1, wherein the fixing film has a layer formed of a polyimide resin and a layer formed of a fluorine type resin.

8. The method according to claim 7, wherein the layer formed of a fluorine type resin contains an electroconductive material.

9. The method according to claim 1, wherein the toner contains colloidal silica fine powder.

10. The method according to claim 9, wherein the colloidal silica fine powder is treated with a silicone oil.

11. The method according to claim 9, wherein the colloidal silica fine powder is treated with 1 to 50 parts by weight of a silicone oil per 100 parts by weight.

12. The method according to claim 11, wherein the colloidal silica is mixed in an amount of 0.1 to 5 parts by weight per 100 parts by weight of the toner.

* * * * *

UNITED STATES PATENT AND TRADEMARK OFFICE

CERTIFICATE OF CORRECTION

PATENT NO. : 5,114,337

DATED : May 19, 1992

INVENTOR(S) : Masuo YAMAZAKI

It is certified that error appears in the above-identified patent and that said Letters Patent is hereby corrected as shown below:

On the title page, items:

[56] REFERENCES CITED

USPD, "Nygand et al." should read --Nygard et al.--.

[57] ABSTRACT

Line 6, "heat" should read --heating--; and

Line 24, "pelled" should read --peeled--.

COLUMN 4

Line 5, "nubmer (1/T)" should read --number (1/T)--;

Line 21, "tonean" should read --tonian--; and

Line 66, "these" should read --there--.

COLUMN 5

Line 27, "ASTM S3418-82" should read --ASTM D3418-82--;

Line 52, "carunauba" should read --carnauba--; and

Line 53, "canderilla" should read --candelilla--.

COLUMN 6

Line 1, "Hanza" should read --Hansa--; and

Line 44, "quatunally" should read --quatunary--.

UNITED STATES PATENT AND TRADEMARK OFFICE

CERTIFICATE OF CORRECTION

PATENT NO. 5,114,337

DATED May 19, 1992

INVENTOR(S) Masuo YAMAZAKI

It is certified that error appears in the above-identified patent and that said Letters Patent is hereby corrected as shown below:

COLUMN 7

Line 16, "ration" should read --ratio--;
Line 47, "ration" should read --ratio--; and
Line 48, "the image" should read --of image--.

Signed and Sealed this

Seventeenth Day of August, 1993

Bruce Lehman

*Attest:*

BRUCE LEHMAN

*Attesting Officer*

*Commissioner of Patents and Trademarks*